US005535976A

United States Patent [19]

Gruneisen, III

[11] Patent Number: 5,535,976

[45] Date of Patent: Jul. 16, 1996

[54] CARD HOLDER

[76] Inventor: Albert H. Gruneisen, III, 1800 Spring Dr., Louisville, Ky. 40205

[21] Appl. No.: 190,778

[22] Filed: Feb. 1, 1994

[51] Int. Cl.[6] ..... A47B 97/00

[52] U.S. Cl. ..... 248/452; 248/121; 248/309.2; 248/174

[58] Field of Search ..... 248/460, 452, 248/441.1, 121, 174, 176, 165, 316.7, 451, 309.2; 40/611, 124.1, 129.4, 376, 388, 401

[56] References Cited

U.S. PATENT DOCUMENTS

| | | | |
|---|---|---|---|
| 198,968 | 1/1878 | Bussey . | |
| 1,063,728 | 6/1913 | Pollard | 248/452 |
| 1,208,687 | 12/1916 | Steinbrunn | 248/460 |
| 1,310,202 | 7/1919 | Metzger . | |
| 1,422,489 | 7/1922 | Smith | 248/451 X |
| 2,138,496 | 11/1938 | Light | 40/388 X |
| 2,413,078 | 12/1946 | Scholfield | 129/16 |
| 2,589,383 | 3/1952 | Holt | 129/16 |
| 3,427,695 | 2/1969 | Cowan | 248/452 X |
| 3,692,273 | 9/1972 | Woolman | 248/460 |
| 4,365,434 | 12/1982 | Doyel | 40/530 |
| 4,645,163 | 2/1987 | Zovar | 248/452 |
| 4,717,110 | 1/1988 | Fohrman | 40/611 X |
| 5,005,796 | 4/1991 | Downie | 248/451 |
| 5,253,840 | 10/1993 | Sherametta | 248/452 |

FOREIGN PATENT DOCUMENTS

| | | | |
|---|---|---|---|
| 946018 | 5/1949 | France . | |
| 2695692 | 3/1994 | France . | |
| 420123 | 10/1925 | Germany . | |
| 287164 | 5/1953 | Switzerland | 248/452 |

*Primary Examiner*—Karen J. Chotkowski
*Attorney, Agent, or Firm*—Middleton & Reutlinger; James C. Eaves, Jr.

[57] ABSTRACT

The present invention relates to a card holder. The holder is useable, for example, to sit on a table in a restaurant and display the menu, drink lists, advertising, and the like. The holder has a stand which detachably receives a clip holding cards. The holder has a tamper resistant appearance but the clip is easily removable from the stand to replace or change the cards.

20 Claims, 4 Drawing Sheets

CARD HOLDER

BACKGROUND OF THE INVENTION (a) Field of the Invention

The present invention relates to a card holder. The holder is useable, for example, to sit on a table in a restaurant and display the menu, drink lists, advertising, and the like. The holder has a stand which detachably receives a clip holding cards. The holder has a tamper resistant appearance but the clip is easily removable from the stand to replace or change the cards.

(b) Description of the Prior Art

U.S. Pat. No. 198,968 teaches a bill file where a base has two wires extending therefrom. The wires form a loop, as they meet at a point. Metallic tags, having a hole therethrough, can be added or removed to the file at the point where the wires meet. The tags can be moved over the wire loop to access the desired bill.

U.S. Pat. No. 1,310,202 teaches a holder for menu cards. A support contains a holder which has two opposed and cooperating members, the members holding one card therebetween.

U.S. Pat. Nos. 2,589,383 and 2,413,078 teach filing apparatus where a stand receives a plurality of cards, for holding recipes, addresses, phone numbers, and the like. The cards typically have apertured portions which permit the cards to be easily added to or deleted from rings in the filing apparatus.

SUMMARY OF THE INVENTION

The present invention is for a card holder. The holder has a stand having a base and an extending support. The support receives a clip which is removable therefrom. Cards, having a clip slot therethrough are inserted onto the clip. The clip removability allows the cards to be easily changed.

The holder of the preferred embodiment has a tamper resistant appearance, as it is not readily apparent that the clip is removable from the stand. An enlarged head at the extending support clip end has a pair of opposed grooves therein. The clip, for example, cylindrical shaped, bends so that its pair of opposed ends almost meet, but have a gap therebetween. This gap permits the clip to be inserted onto the head so that the clip opposed ends engage the opposed grooves to retain the clip on the support.

The card holder base sits on a table, or the like. The cards held by the clip hang downward. A person can flip through the cards to look at the information they contain. The extending support can have various shapes, e.g. planar, sloped, or "S"-shaped.

BRIEF DESCRIPTION OF THE DRAWINGS

A better understanding of the present invention will be had upon reference to the following description in conjunction with the accompanying drawings, wherein.

DETAILED DESCRIPTION OF THE PREFERRED EMBODIMENT

Figure 2:
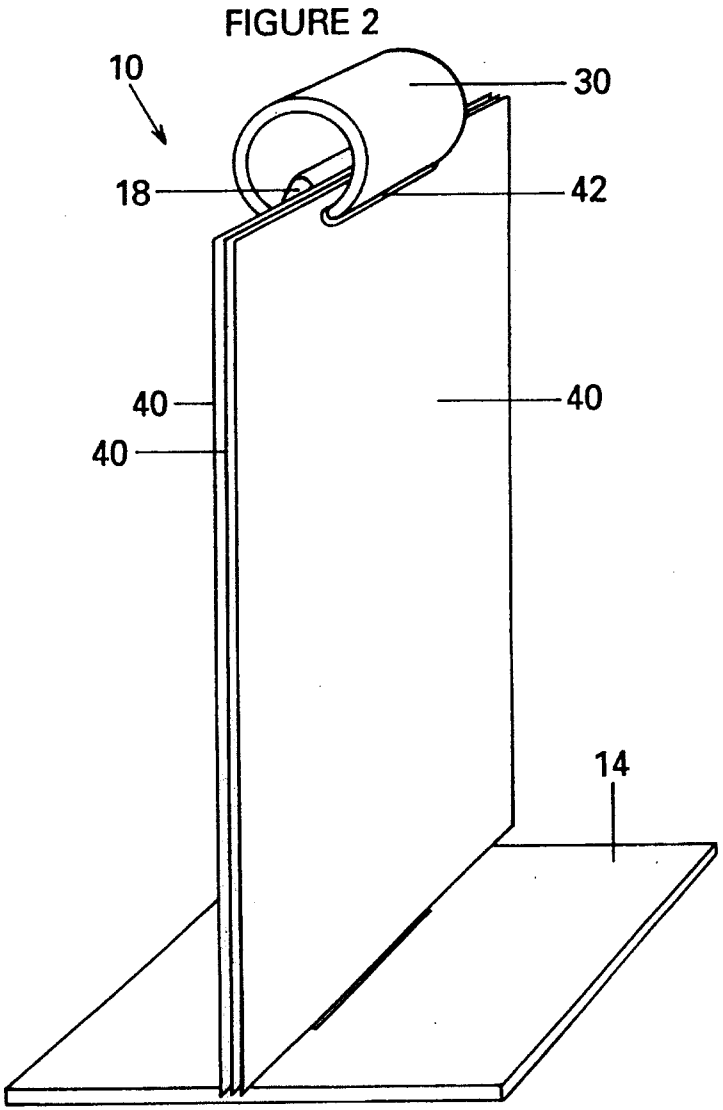
FIG. 2 shows a perspective view of the card holder of FIG. 1, the card holder holding cards.
Figure 1:
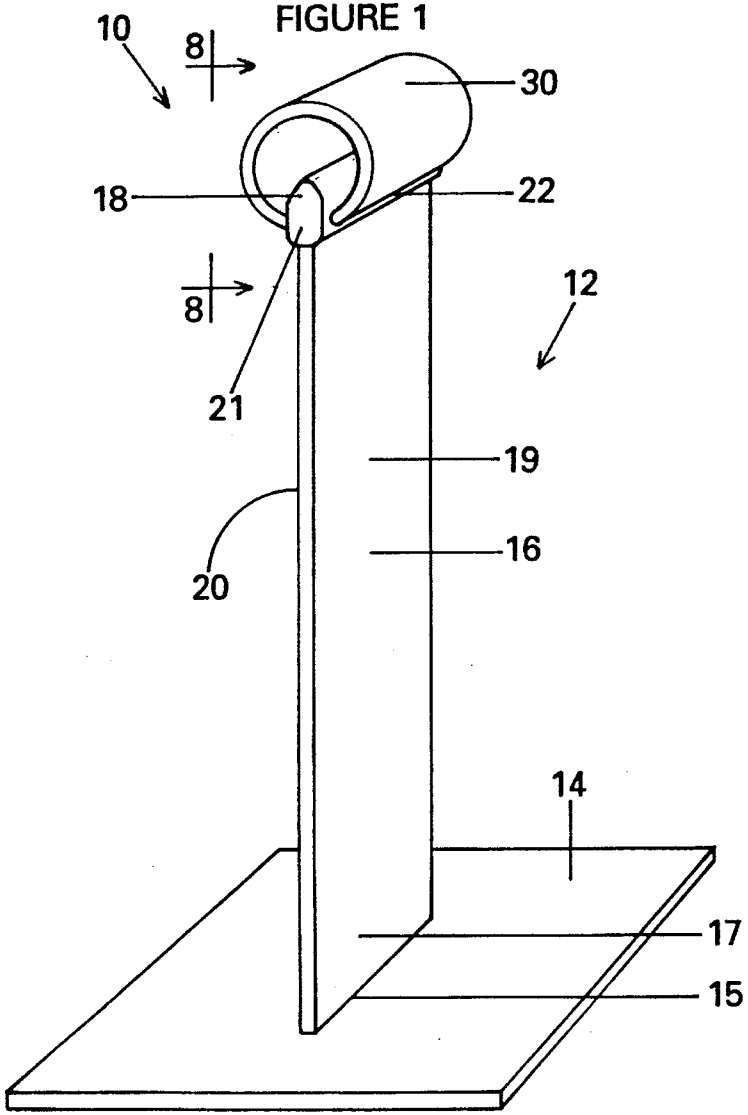
FIG. 1 shows a perspective view of the card holder of the preferred embodiment.

With reference to FIGS. 1 and 2, the preferred embodiment of the card holder 10 of the present invention is shown having a stand 12 and clip 30 detachable therefrom. As seen in FIG. 2, clip 30 receives at least one card 40 having a clip slot 42 therethrough. Cards 40 may, for example, contain advertising, menu lists, drink lists, or related material. The cards 40 may be plastic, plastic-coated paper, laminated paper, or the like, as the cards 40 should receive a lot of handling, for example, if used to present a restaurant menu to the customers.

With reference to FIGS. 1, 2, and 5–7, the stand 12 is shown having a base 14 and an extending support 16. The support 16 should be sized so that the cards 40 to be employed with the stand can hang freely from clip 30. For example, the stand 12 could be six or seven inches in height. Stand 12 can be of unitary or two-part construction, for example. Plastic is a preferred material, particularly for ease of cleaning if used in the food and drink industry. The inventor currently makes the stand 12 of the preferred embodiment as a unitary stand by injection molding, for example. However, many other materials and manufacturing methods can be employed.

Support 16 is shown having a base end 17 and a clip end 18. Support 16 has a first side 19 and an opposed side 20. In the two-part construction shown, base 14 has a slot 15 therethrough. Slot 15 receives base end 17 of support 16. This connection can be secured in many ways, such as, for example, by gluing or heat sealing. This connection can also be a snap-together connection easy assembly/disassembly.

With reference to FIGS. 1, 5, and 8–10, support 16 is shown having an enlarged head 21 toward the clip end 18. Head 21 has a groove 22 on first side 19 and a groove 23 on the opposed second side 20. The grooves 22/23 are in a parallel relationship. Grooves 22/23 are sized to receive clip 30 therein. As seen, clip 30 has a generally cylindrical shape. Clip 30 has been formed by having its opposed ends 32 and 33 bent so that the ends 32 and 33 have a parallel cooperating relationship. The ends 32/33 have a gap 34 therebetween. With clip 30 in a relaxed condition, not inserted onto stand 12, the width of the gap 34, that being the distance between ends 32 and 33, is desirably less than the width of the portion of head 21 between grooves 22/23. This spacing causes the clip 30 to snap into the grooves 22/23 so that the ends 32/33 of clip 30 are retained in a slightly spread apart condition. This force causes the clip 30 to be more securely retained by the stand 12, thereby giving a tamper resistant appearance and feel. However, the clip 30 can be easily removed from grooves 22/23 to remove and replace the cards 40.

It is noted that the enlarged head 21 is shown having a taper from clip end 18. This taper makes it easier to place the clip 30 onto head 21 so that ends 32/33 engage grooves 22/23. In addition, a small portion of about 1.5 mm, for example, from each end 32/33, away from gap 34, can be bent to lie in the same plane. This permits an even better receipt by grooves 22/23 of clip 30.

Figure 11:
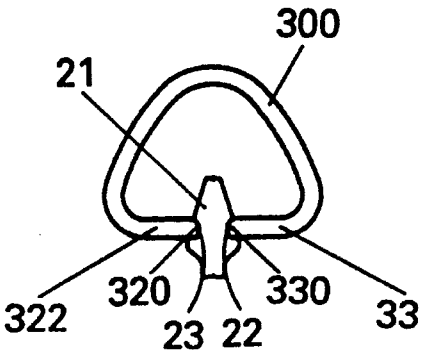
FIG. 11 shows an alternative spade clip having its ends detachably retailed within the support grooves.
Figure 12:
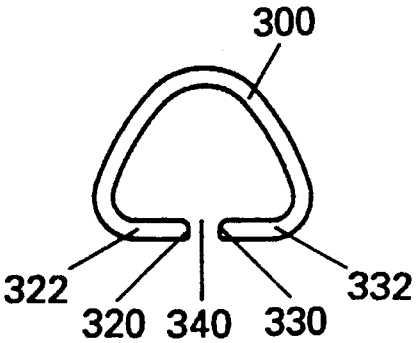
FIG. 12 shows an end view of the clip of FIG. 11.
Figure 13:
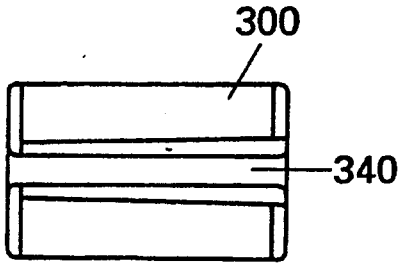
FIG. 13 shows a bottom view of the clip of FIG. 11.

With reference to FIGS. 11–13, an alternative clip 300 is shown. When viewed from the end, clip 300 has a "spade"-shaped cross-section, in contrast to clip 30's cylindrical cross-section. Clip 300, like clip 30, has opposed ends 320 and 330 bent so that the ends 320 and 330 are in a parallel relationship. The ends 320/330 have a gap 340 therebetween. The width of the gap 340, that being the distance between ends 320 and 330, is desirably less than the width of the portion of head 21 between grooves 22/23. Clip 300 has portions 322 and 332 toward its respective ends 320 and 330 which lie in a common plane. This relationship allows a plurality of cards 40 being contained on clip 300 to hang "equally", giving a neat appearance. For example, when wanting to insert twenty cards onto a clip, the spade type clip 300 would present the cards better than a "similar" sized clip 30, as the cards would ride uphill on the clip 30. Clips having other shapes can also be employed.

Figure 3:
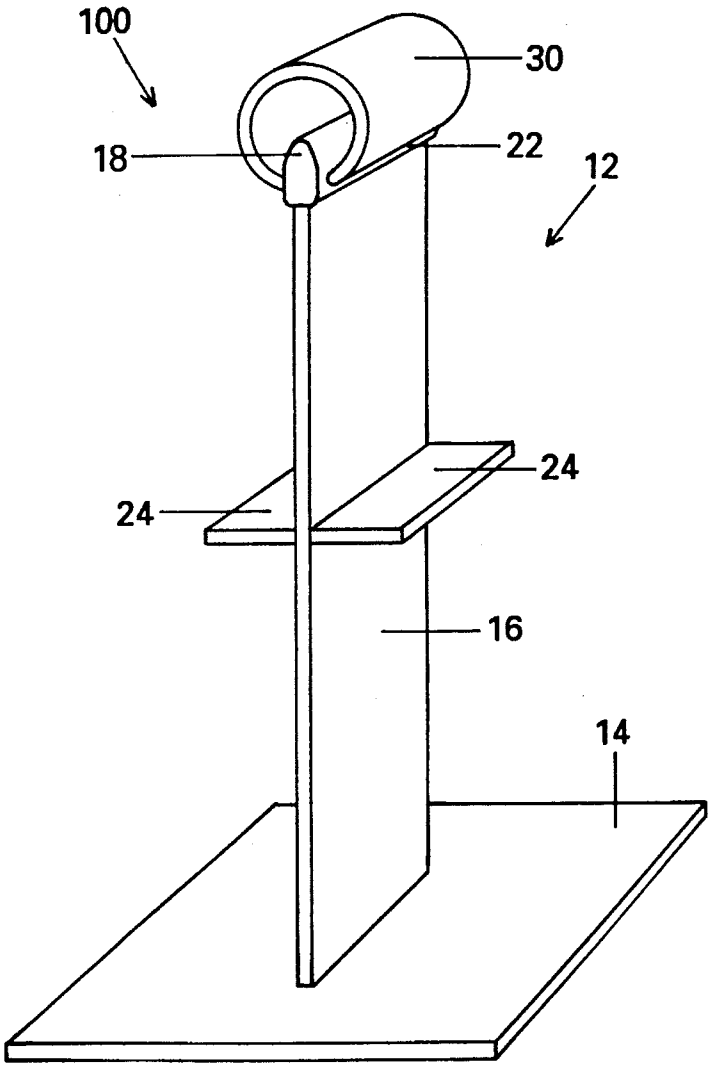
FIG. 3 shows a perspective view of a first alternative embodiment card holder.
Figure 7:
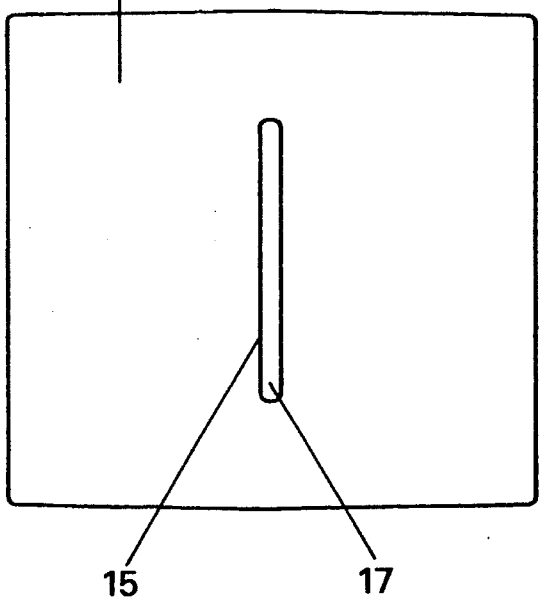
FIG. 7 shows a bottom view of the stand of the card holder of FIG. 1.
Figure 6:
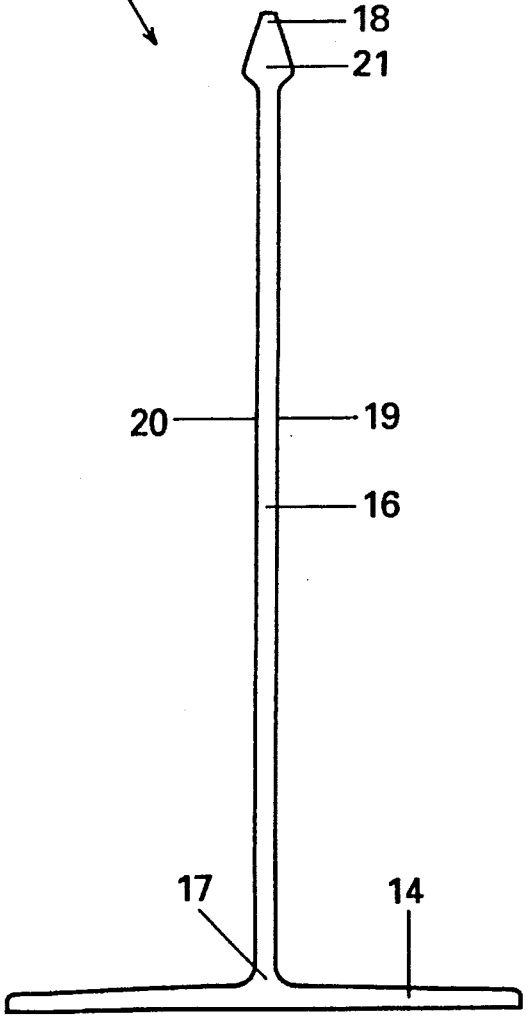
FIG. 6 shows a side view of the stand of the card holder of FIG. 1.
Figure 5:
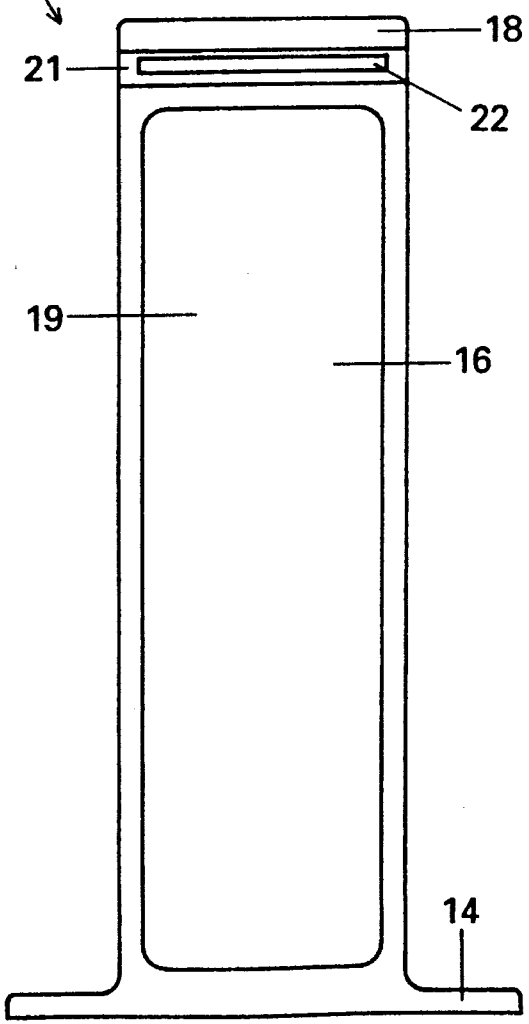
FIG. 5 shows a front view of the stand of the card holder of FIG. 1.
Figure 8:
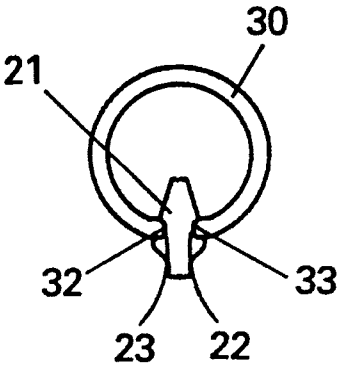
FIG. 8 shows a cross-section view along the lines 8—8 of FIG. 1 showing a cylindrical clip having its ends detachably retained within the support grooves.
Figure 9:
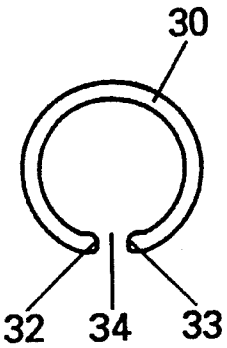
FIG. 9 shows an end view of the clip of FIG. 8.
Figure 10:
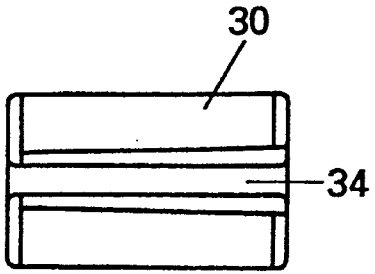
FIG. 10 shows a bottom view of the clip of FIG. 8.

With reference to FIG. 3, a first alternative embodiment of a card holder 100 is shown. The stand 12 of FIG. 3 incorporates a pair of wings 24 extending from opposite sides of support 16. While shown transverse to support 16, the wings 24 could have any desired slope. Also, a wing could be included on only one side of support 16. The wings 24 serve to alter the hang of the cards 40. Without the wings 24, cards 40 will hang downward. With wings 24, the cards 40 will have their bottom portions closer to the reader. This can make any writing on the cards 40 easier to read. Wings 24 can be incorporated with any of the embodiments taught.

Figure 4:
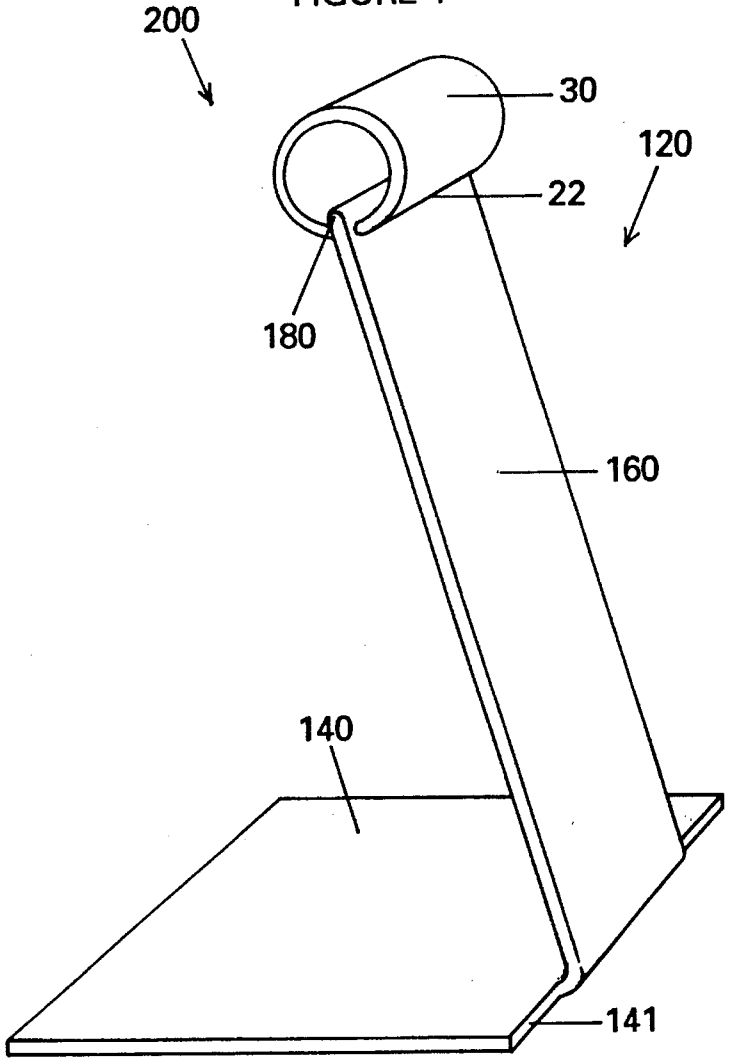
FIG. 4 shows a perspective view of a second alternative embodiment card holder.

With reference to FIG. 4, a second alternative embodiment of a card holder 200. Instead of having a vertically extending support 16 from about the midportion of base 14, as seen in the previous embodiments, the stand 120 of card holder 200 has a base 140 which has a sloping support 160 from an edge 141 of base 140. With this configuration, cards 40 inserted onto a clip 30 will rest against support 160 and have their card 40 bottoms sloped toward the reader. The support size and slope, the clip, and the number of cards determine the size and shape of the base, as the base needs to be sized so as to provide a stable base or footprint for the support and cards.

In stand 120 of FIG. 4, the clip end 180 of support 160 differs from the clip end 18 of FIG. 1, as there is no enlarged head portion 21. Extending support 160 has a uniform thickness. Clip end 180 is rounded for ease of insertion of clip 30 thereover. Toward clip end 180 support 160 does contain parallel grooves 22/23 on the opposite sides of support 160. However, without the enlarged head portion 21, these grooves 22/23 may not be as deep as those with support 12. As was described with holder 10, also with stand 120, the distance between grooves 22/23 should be greater than the width of gap 340. It is noted that, without the enlarged head portion 21, the stand 120 does not appear as tamper resistant as the stand 12 of FIG. 1.

Many additional stand shapes and sizes can be employed. For example, an "S"-shaped support could be used, where a clip is inserted into grooves toward the end of the "S" support. Cards 40 would hang downward. As the cards 40 are flipped upward by a reader, the "flipped" cards would rest on a portion of the "S" support.

The foregoing detailed description is given primarily for clearness of understanding and no unnecessary limitations are to be understood therefrom for modifications can be made by those skilled in the art upon reading this disclosure and may be made without departing from the spirit of the invention and scope of the appended claims.

What is claimed is:

1. A card holder comprising:

(a.) a stand, said stand having a base and a support extending therefrom, said support having a base end and a clip end, said support having a first side and a second side;

(b.) means for holding cards, said holding means being detachably received by said support;

(c.) said support clip end having an enlarged head portion, said enlarged head portion having a first groove into said support first side and a second groove into said support second side, said first groove and said second groove having a parallel relationship, where said first groove and said second groove detachably receive said holding means.

2. The card holder of claim 1, said holding means comprising a clip, said clip having opposing ends in a cooperating relationship, said opposing ends being detachably received by said first and said second groove.

3. The card holder of claim 2, where said first and said second groove have a first width therebetween, where, in a relaxed condition, said clip opposing ends have a second width therebetween, said first width being greater than said second width.

4. A card holder, comprising:

(a.) a stand, said stand having a base and a support extending therefrom, said support having a base end and a clip end, said support having a first side and a second side;

(b.) means for holding cards, said holding means being detachably received by said support;

(c.) said support having a first groove into said support first side and a second groove into said support second side, said first groove and said second groove having a parallel relationship and having a location toward said clip end, where said first groove and said second groove detachably receive said holding means.

5. The card holder of claim 4, further comprising at least one wing, said at least one wing extending from said support.

6. The card holder of claim 4, where said support has a rectangular shape.

7. The card holder of claim 4, where said support is in a transverse alignment with said base.

8. The card holder of claim 4, further comprising at least one card, said at least one card having a top and a bottom, said at least one card having a clip slot therethrough toward said top, said holding means receiving said clip slot to retain said at least one card being thereon, where said support has a first height and said at least one card has a second height, said first height being greater than said second height, whereby said at least one card hangs freely from said holding means.

9. The card holder of claim 4, said holding means comprising a clip, said clip having opposing ends in a cooperating relationship, said opposing ends being detachably received by said first and said second groove.

10. The card holder of claim 9, where said first and said second groove have a first width therebetween, where, in a relaxed condition, said clip opposing ends have a second width therebetween, said first width being greater than said second width.

11. The card holder of claim 9, where said clip opposing ends have respective end portions lying in a common plane.

12. The card holder of claim 4, where said holding means comprising a clip, said clip having opposing ends in a cooperating relationship, said opposing ends being detachably received by said support toward said clip end, and where said clip has a generally spade-shaped cross-section.

13. The card holder of claim 4, where said stand and said holding means are constructed from a plastic material.

14. The card holder of claim 4, where said stand is of unitary construction.

15. The card holder of claim 14, where said stand is injection molded.

16. The card holder of claim 4, where said base and said support are of a two-part construction, said base having a slot therein, said slot receiving said base end of said support.

17. The card holder of claim 4, where said base has a midportion and where said support extends from said base midportion.

18. The card holder of claim 4, where said base has an edge and where said support extends from said base edge.

19. The card holder of claim 4, where said support has a taper from said first and said second grooves toward said clip end.

20. The card holder of claim 4, where said holding means comprising a clip, said clip having opposing ends in a cooperating relationship, said opposing ends being detachably received by said support toward said clip end, and where said clip has a generally circular shaped cross-section.

* * * * *